US006540574B2

(12) United States Patent
Hashizume et al.

(10) Patent No.: US 6,540,574 B2
(45) Date of Patent: Apr. 1, 2003

(54) FOLDABLE DIVING FLIPPERS

(76) Inventors: Hideya Hashizume, 4-27-7, Miwa, Sanda, Hyogo, 669 (JP); Soichi Hashizume, 4-27-7, Miwa, Sanda, Hyogo, 669 (JP)

( * ) Notice: Subject to any disclaimer, the term of this patent is extended or adjusted under 35 U.S.C. 154(b) by 0 days.

(21) Appl. No.: 09/947,340

(22) Filed: Sep. 7, 2001

(65) Prior Publication Data

US 2002/0028618 A1 Mar. 7, 2002

(30) Foreign Application Priority Data

Sep. 7, 2000 (JP) ..... 2000-271386

(51) Int. Cl.[7] ..... A63B 31/08

(52) U.S. Cl. ..... 441/64

(58) Field of Search ..... 441/64

(56) References Cited

U.S. PATENT DOCUMENTS

| | | | | | |
|---|---|---|---|---|---|
| 4,752,259 | A | * | 6/1988 | Tackett et al. | 441/64 |
| 4,981,454 | A | * | 1/1991 | Klein | 441/62 |
| 5,292,272 | A | * | 3/1994 | Grim | 441/62 |
| 5,447,457 | A | * | 9/1995 | Kamitani | 414/64 |
| 6,120,336 | A | * | 9/2000 | Kawai et al. | 441/62 |
| 6,152,794 | A | * | 11/2000 | Liu | 441/64 |

* cited by examiner

*Primary Examiner*—Stephen Avila
(74) *Attorney, Agent, or Firm*—Wenderoth, Lind & Ponack, L.L.P.

(57) ABSTRACT

A diving flipper is provided wherein a blade is attached to a body 1, which is secured to a foot, so that the position of the blade can be switched between a position for use and a folded position. The folded position is attained by rotating the blade about an axis in a base, or at a front of the body. This flipper can be used for swimming in the same manner as a conventional flipper when the blade is in the position for use, and the user can easily climb a ladder of a boat or walk without the blade causing interference when the blade is switched to the folded position.

42 Claims, 15 Drawing Sheets

FOLDABLE DIVING FLIPPERS

BACKGROUND OF THE INVENTION

1. Field of the Invention

This invention relates to diving flippers, in particular to diving flippers of which the blades are foldable.

2. Description of the Background Art

Conventionally, a foot pocket into which a foot is inserted and a blade for propulsion through water are integrated in a diving flipper and, as for a system for attachment to the foot, there are a strap type wherein a strap for securing the flipper to the foot is provided at an opening of a rear end of the foot pocket, a full foot type wherein the foot pocket envelopes the foot. Though, usually, a foot is inserted into this foot pocket with a boot worn on the foot, a bare foot may be inserted in the case of the full foot type.

After diving with such a flipper on, it must be taken off by releasing the strap or by turning the foot pocket inside out in order to make it easy to climb a ladder from the water into a boat.

In addition, at the time of performing a dive from shore, flippers must be put on or taken off at a certain water depth because it is difficult to walk with the flippers on. It is difficult, however, to put on or take off flippers at a time when waves or tidal flows are strong, and there is a risk that water may be inhaled from a snorkel or that the flippers may be washed away.

Therefore, a purpose of this invention is to provide flippers that make it possible to climb a ladder of a boat or walk while wearing the flippers.

SUMMARY OF THE INVENTION

In a diving flipper according to this invention, a blade is attached to a body which is secured to a foot so that a position of the blade can be switched between a position for use and a folded position. The folded position is attained through rotation of the blade about an axis in a base, or at a front of the body.

This flipper can be used for swimming in the same manner as conventional flipper when the blade is in the position for use, and the user can easily climb a ladder of a boat or walk without the blade causing interference when the blade is switched to the folded position.

These and other objects, features, aspects and advantages of the present invention will become clearer from the following detailed description of the present invention when taken in conjunction with the accompanying drawings.

DESCRIPTION OF THE PREFERRED EMBODIMENTS

A diving flipper according to the present invention is described with reference to FIGS. 1 to 4.

Figure 1:
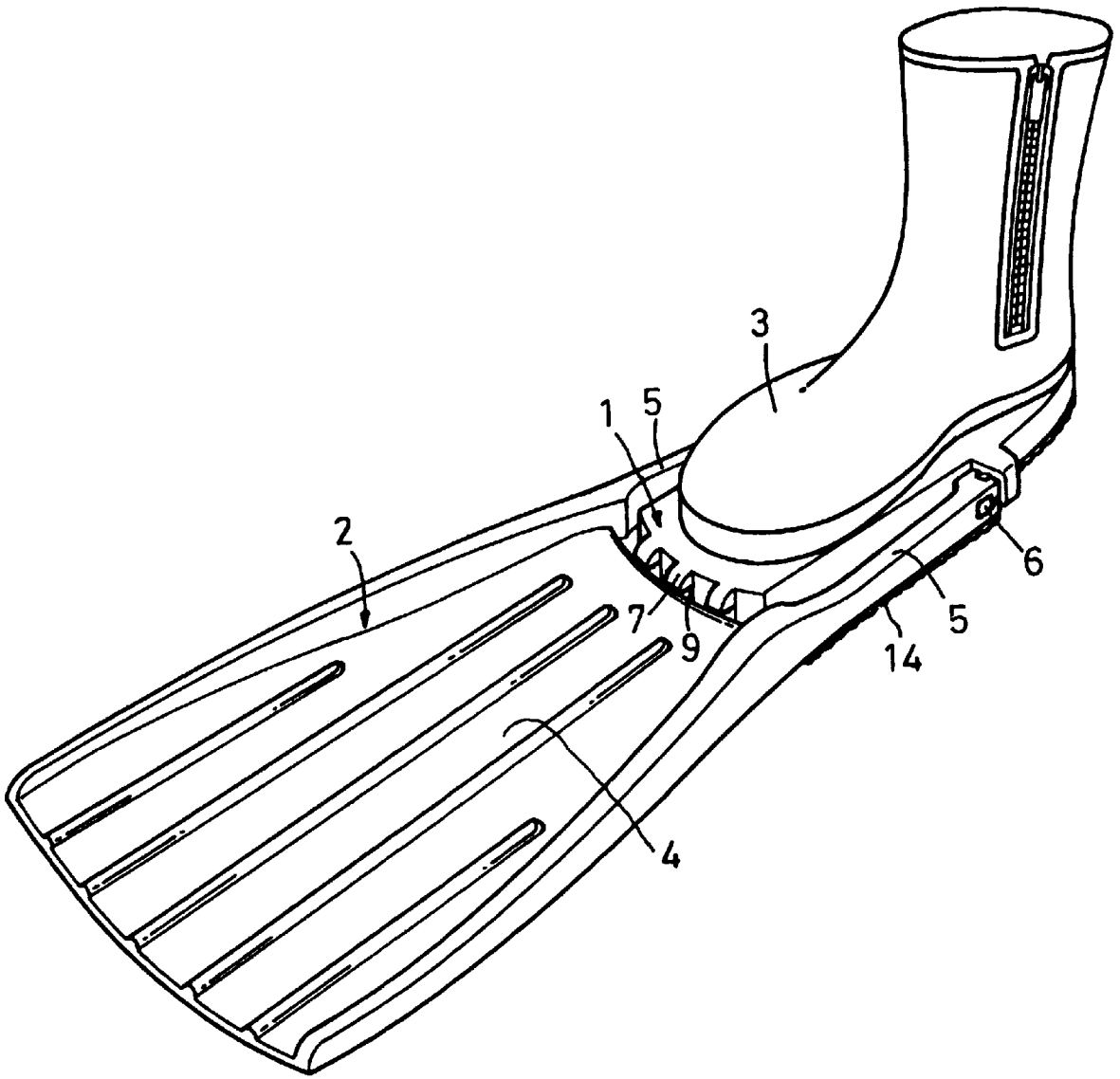
FIG. 1 is a perspective view showing a diving flipper in a position for use according to the present invention.

As shown in FIG. 1, a flipper is made up of a body 1 and a blade 2, and a boot 3 is secured to a top surface of the body 1. On both sides of a webbed part 4 of the blade 2 stays 5 are provided extending rearwardly so that ends of these stays 5 are attached to a base of the body 1 so as to be rotatable via an axis 6.

Figure 2:
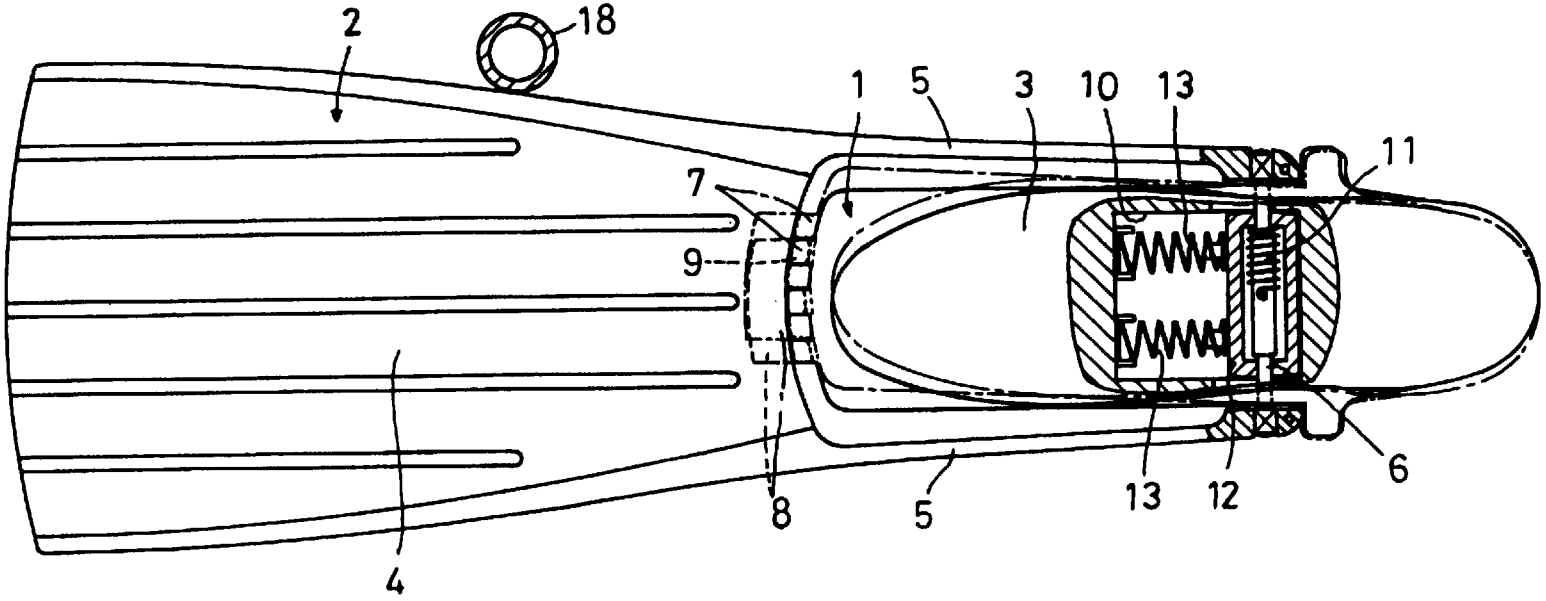
FIG. 2 is a partial sectional plan view of the diving flipper of FIG. 1.
Figure 3:
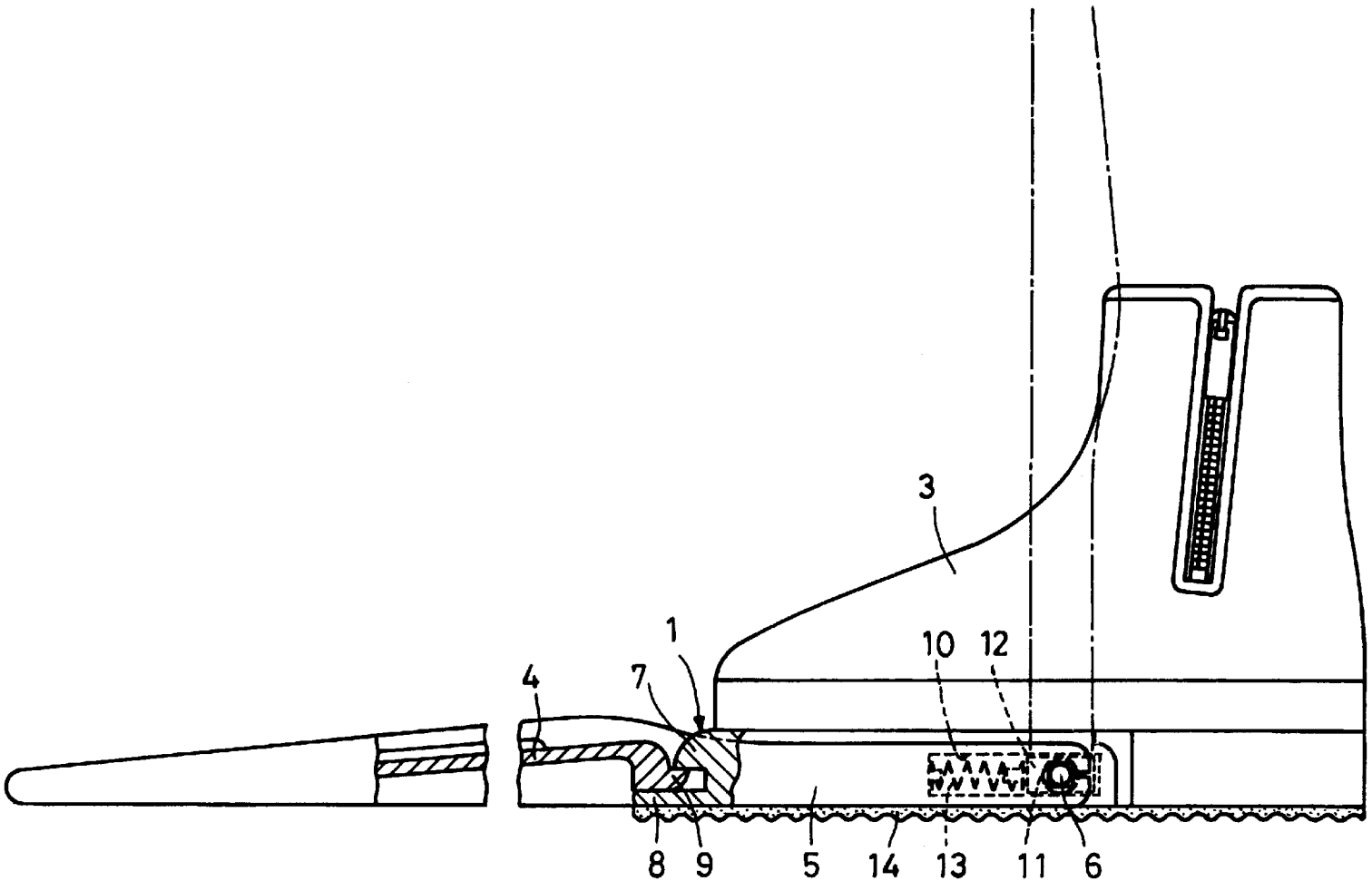
FIG. 3 is a partial sectional side view of the diving flipper of FIG. 1.

As shown in FIGS. 2 and 3, a front end of the body 1 is provided with three protruding parts 7 and a support 8 which holds a rear end of the webbed part 4, while the rear end of the webbed part 4 of the blade 2 is provided with three protruding parts 9 which slide beneath three protruding parts 7. Rear sides of the protruding parts 7 and 9 are of a tapered shape.

A spring chamber 10 is formed inside of the body 1 so that a twisted coil spring 11 is engaged around the axis 6 in this spring chamber 10. This twisted coil spring 11 is contained in a spring case 12 in order to provide a force to fold the blade 2.

Both sides of the spring case 12 are of an are form and these sides are controlled by sides of the spring chamber 10 so that the body 1 rocks from left to right and vice versa.

Two compressed coil springs 13 are placed between the spring chamber 10 and a front side of the spring case 12 so that the body 1 is directed to a stable position by means of these compressed coil springs 13. In addition, a sole 14 made of rubber is attached to a bottom of the body 1.

When swimming in water with the above described flipper, the boot 3 is worn and the blade 2 is set at a position for use so as to extend forwardly from the body 1 as shown in FIG. 1. In this condition, the protruding parts 9 of the blade 2 are held by the protruding parts 7 of the body 1 so as to secure the blade 2, and the flipper can be used for swimming in the same manner as a conventional flipper.

Figure 5:
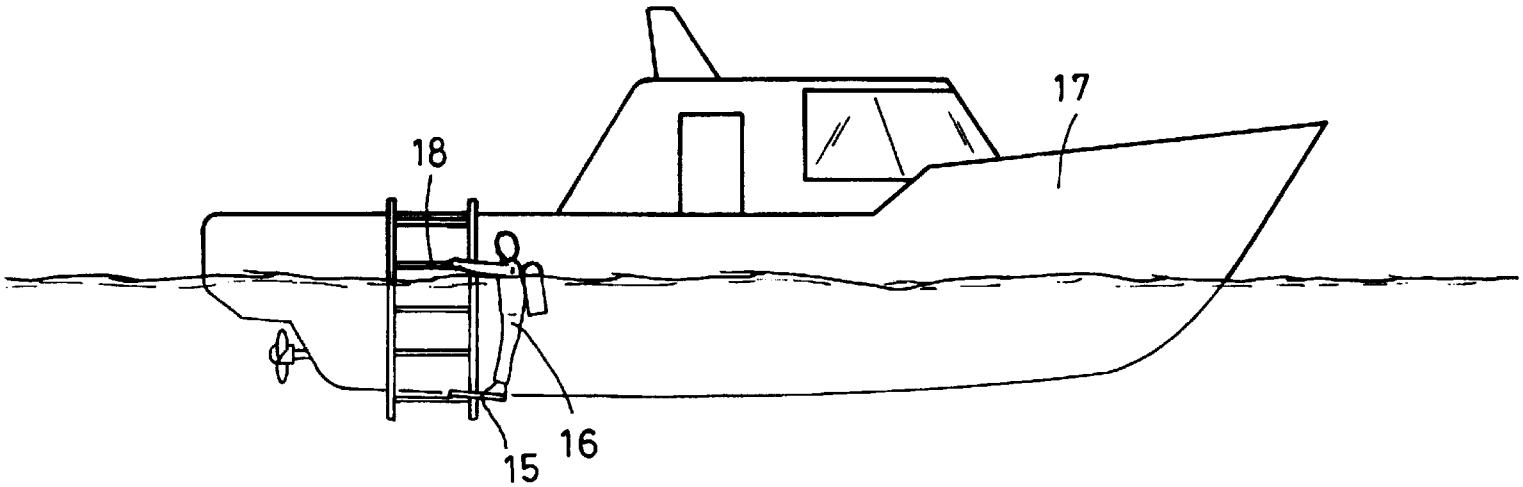
FIG. 5 is a view showing a situation where a diver wearing the diving flipper of FIG. 1 is climbing a ladder onto a boat.

On the other hand, as shown in FIG. 5, at a time when a diver 16 wearing the flipper 15 climbs up onto a boat 17 after finishing diving, the diver 16 may turn his foot and press a side of the flipper 15 against a ladder 18 while holding the ladder 18 hung from the boat 17.

Figure 4:
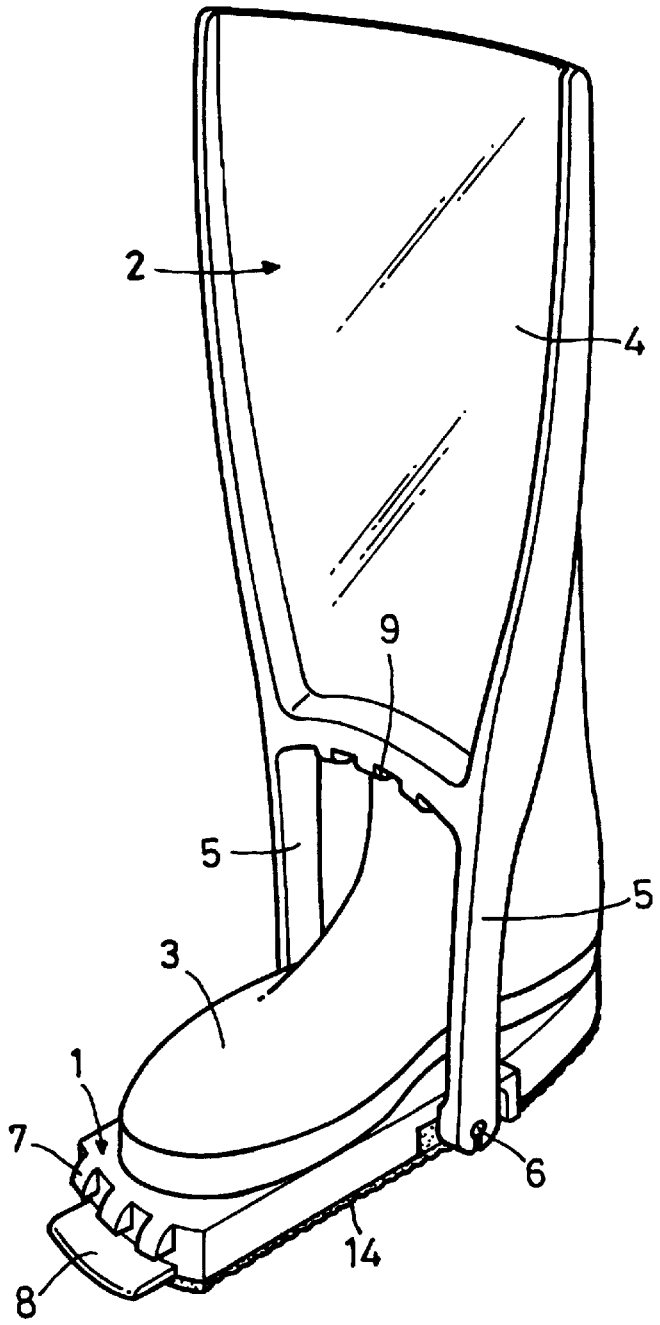
FIG. 4 is a perspective view of the diving flipper of FIG. 1 in a folded position.

When the blade 2 is turned in such a manner, as shown with a broken line in FIG. 3, the engagement between the protruding parts 7 and 9 is released and the blade 2 becomes raised, as shown with the broken line in FIG. 3, due to pressure from the twisted coil spring 11 so as to be switched to a folded position as shown in FIG. 4 so as to enable easy climbing of the ladder 18.

In addition, when the blade 2 is folded in this manner, the user can walk and, therefore, at a time of entering water from a shore, the flipper can be put on in advance of walking into the water. When a certain depth of water is reached, the blade 2 is pushed down so as to make the protruding parts 7 and 9 contact one another, and then the blade 2 is moved forwardly. Thereafter, because of pressure by the compressed coil springs 13, the protruding parts 9 are engaged between the protruding parts 7 and the support 8 so as to secure the blade 2 at a position for use, and the user can then begin to swim.

Then, when returning to the shore the user turns his foot while pressing a side of the flipper against a seabed or a rock, whereby the blade 2 becomes raised so as to become switched to the folded position, and the user can exit the water on foot without taking off the flipper.

In this diving flipper, the engagement between the protruding parts 7 and 9 can be released in whichever direction, left or right, the foot is turned; however it is possible to provide a flipper wherein the engagement may be released so as to switch the lade into the folded position only when the foot is turned in one direction.

In addition, though a mechanisms in which the compressed coil springs 13 press the spring case 12 is adopted, this mechanism may be provided with other types of elastic bodies such as plates of rubber instead of the compressed coil springs 13, or this mechanism can be omitted in the case that the blade is made to slide relative to the body 1 through elasticity of the stays 5.

In addition, the mechanism wherein the blade 2 is moved to the folded position by means of the twisted coil spring 11 can also be omitted in the case that, for example, the user switches the blade between the position for use and the folded position by his own force.

Figure 6:
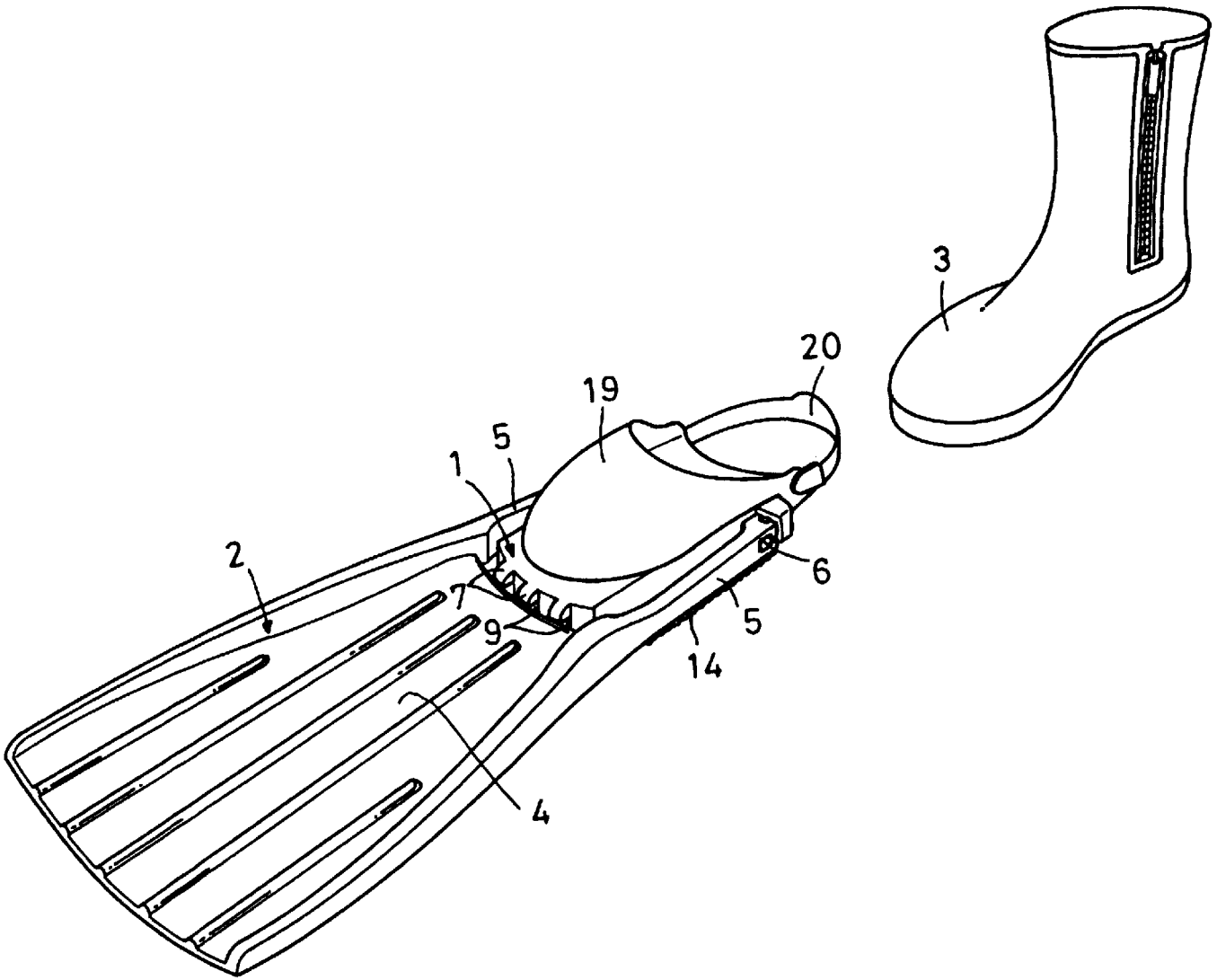
FIG. 6 is a perspective view showing another diving flipper in a position for use according to this invention.

Next, another diving flipper according to the present invention is described with reference to FIG. 6. In this flipper the boot 3 is not secured to the body 1 as in the above described diving flipper but, rather, a foot pocket 19 is provided so that the boot 3 can be inserted into or withdrawn from the body 1, and the boot 3 inserted into this pocket 19 is held to the body 1 with a strap 20, which works as a rear foot holder. The blade 2 is foldable in this diving flipper in the same manner as in the above diving flipper and, in addition, in the same manner as a conventional flipper, the foot can be withdrawn from the foot pocket 19 by releasing the strap 20 so that the user can climb a ladder or can walk with the boot 3 on.

Figure 7:
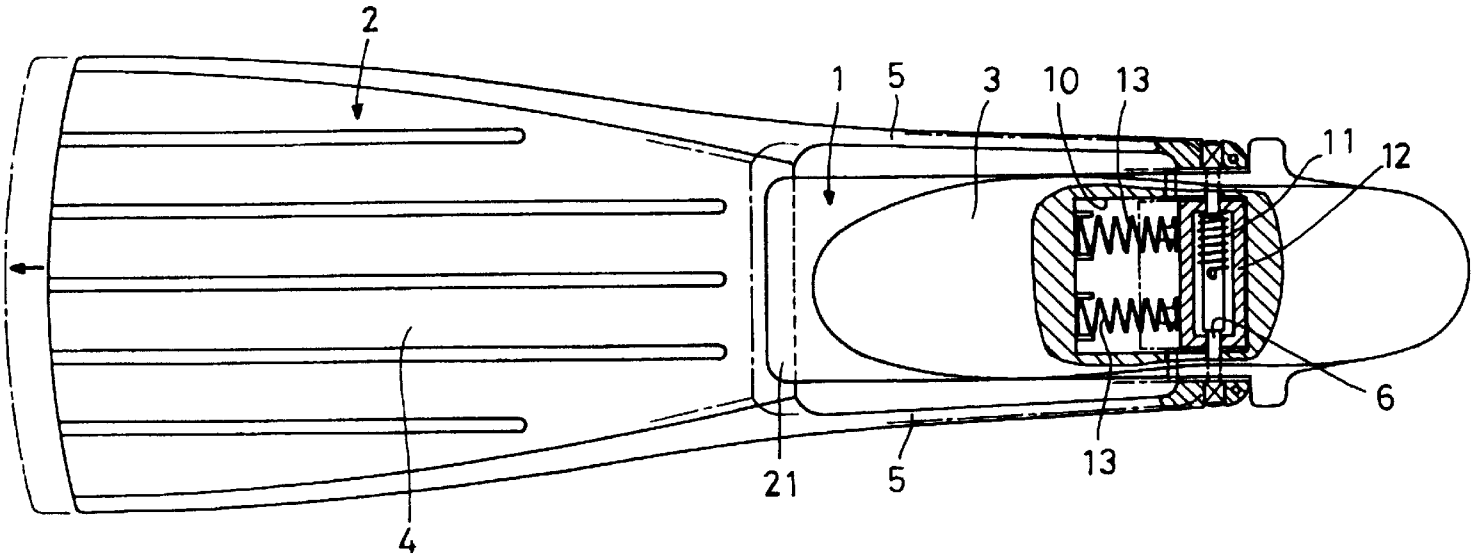
FIG. 7 is a perspective view showing yet another diving flipper in a position for use according to this invention.

Next, yet another diving flipper according to the present invention is described with reference to FIG. 7.

In this diving flipper the engagement of the blade 2 to the body 1 is not released by turning the foot as in the above described diving flippers but, rather, the blade 2 is made to be moveable by pulling the blade 2 to the front so that a rear end of the webbed part 4 is released from a securing piece 21 at a front end of the body 1.

In such a diving flipper, the blade 2 can be folded in the same manner as in the above diving flippers so that the user can climb a ladder or walk.

As described above, according to this invention a diving flipper is provided which can be used in the same manner as is a conventional flipper when the blade is set at a position for use, and can enable easy climbing of a ladder into a boat and walking without hinderance by the blade.

Figure 8:
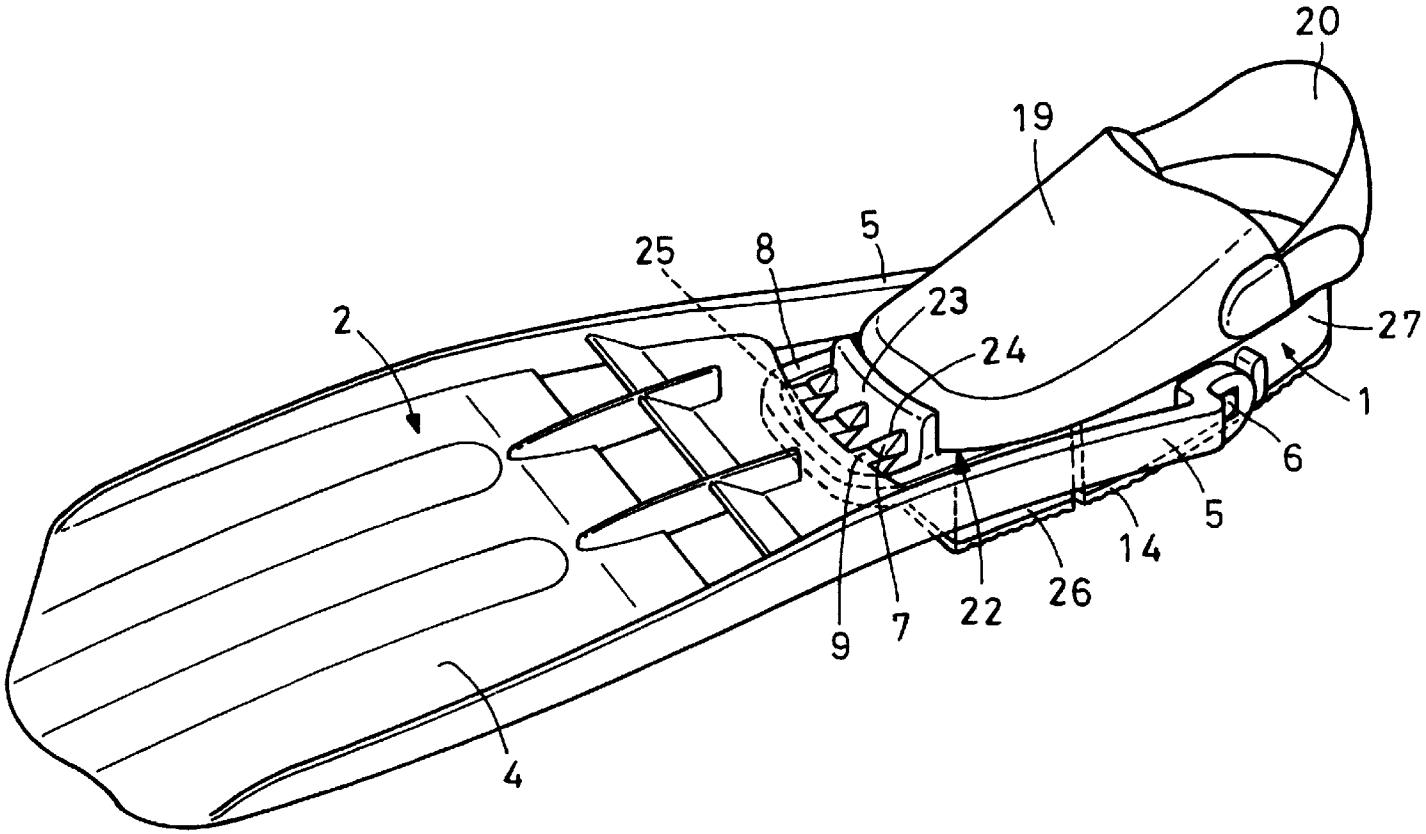
FIG. 8 is a perspective view showing still another diving flipper in a position for use according to the present invention.
Figure 9:
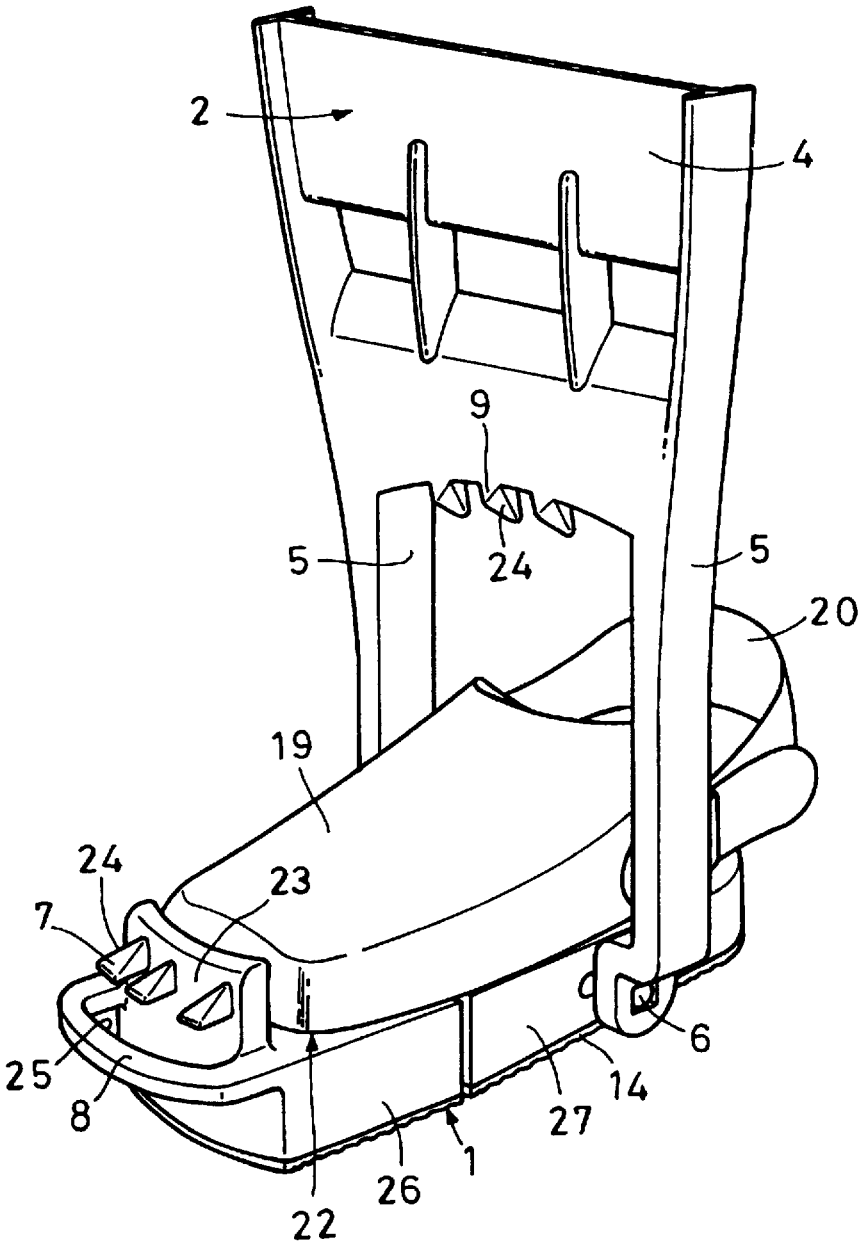
FIG. 9 is a perspective view of the diving flipper of FIG. 8 in a folded position.

As shown in FIGS. 8 and 9, still another diving flipper according to the present invention comprises a body 1 and a blade 2. Stays 5 extend rearwardly from both sides of a webbed part 4 of the blade 2 so that ends thereof are attached to the body 1 so as to be freely rotatable via an axis 6.

A foot pocket 19 is attached to a top surface of a foot securing base 22 of the body 1 and is provided with a strap 20 at its rear end. On a bottom surface of the body 1 a bottom material 14 made of rubber is secured.

A front wall 23 which extends upwardly from the foot securing base 22 is provided at a front part of the body 1, and three protruding parts 7 are provided at a front surface of this front wall 23. In addition, three protruding parts 9 which slip beneath the protruding parts 7 are provided at a rear end of the webbed part 4 of the blade 2. A sloped surface 24 is formed on one side of each of the protruding parts 7 and 9 so that the blade 2 slides to one side before engaging the body 1 when it is pressed downwardly.

Beneath the protruding parts 7 a support 8 is provided so as to protrude from the body 1 and support the rear end of the webbed part 4, and an aperture 25 is created in this support 8 as a means for preventing accumulation of sand.

Figure 10:
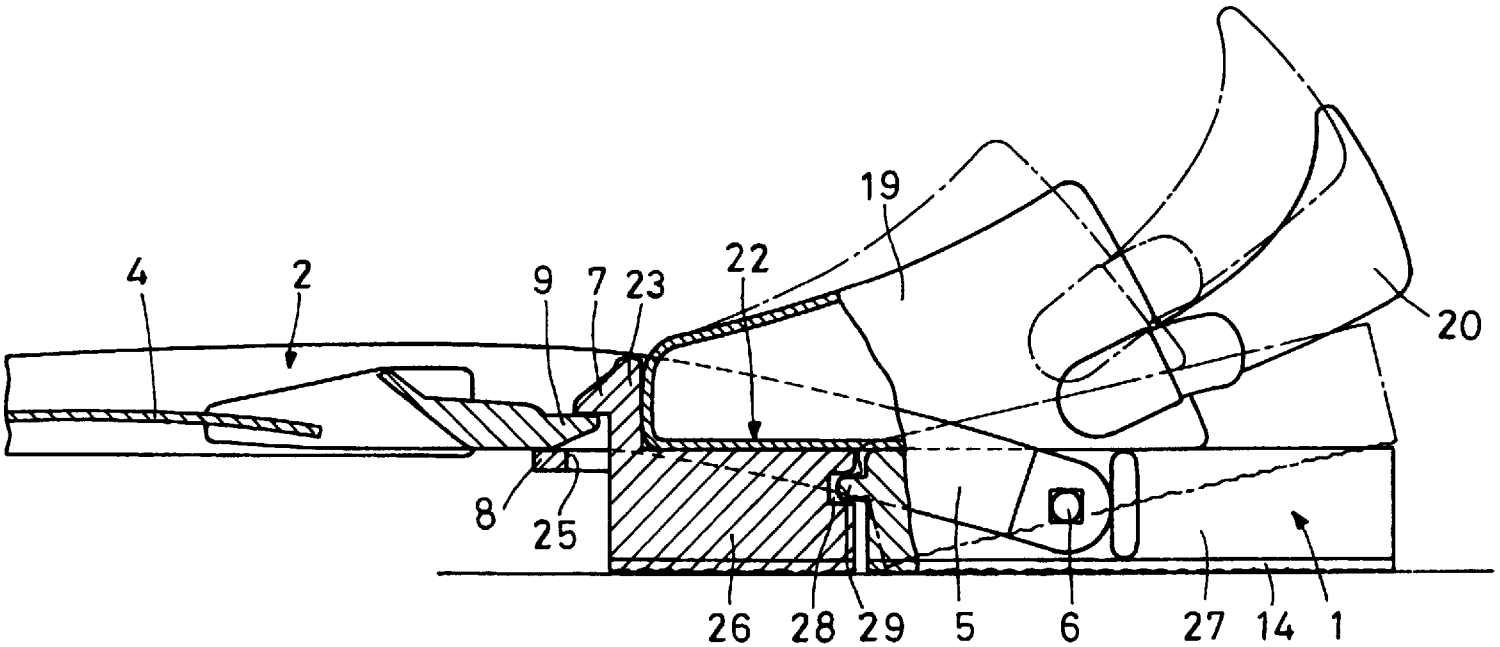
FIG. 10 is a partial sectional side view of the diving flipper of FIG. 8.

The foot securing base 22 of the body 1 is divided into a front part 26 and a rear part 27 as shown in FIG. 10, wherein the front part 26 and the rear par 27 are engaged in a movable manner by inserting a male part 29 of one of the parts 26, 27 into a female part 28 of the other of the parts 26, 27 so as to form a connection which freely flexes along a bottom part of the foot pocket 19.

Figure 11:
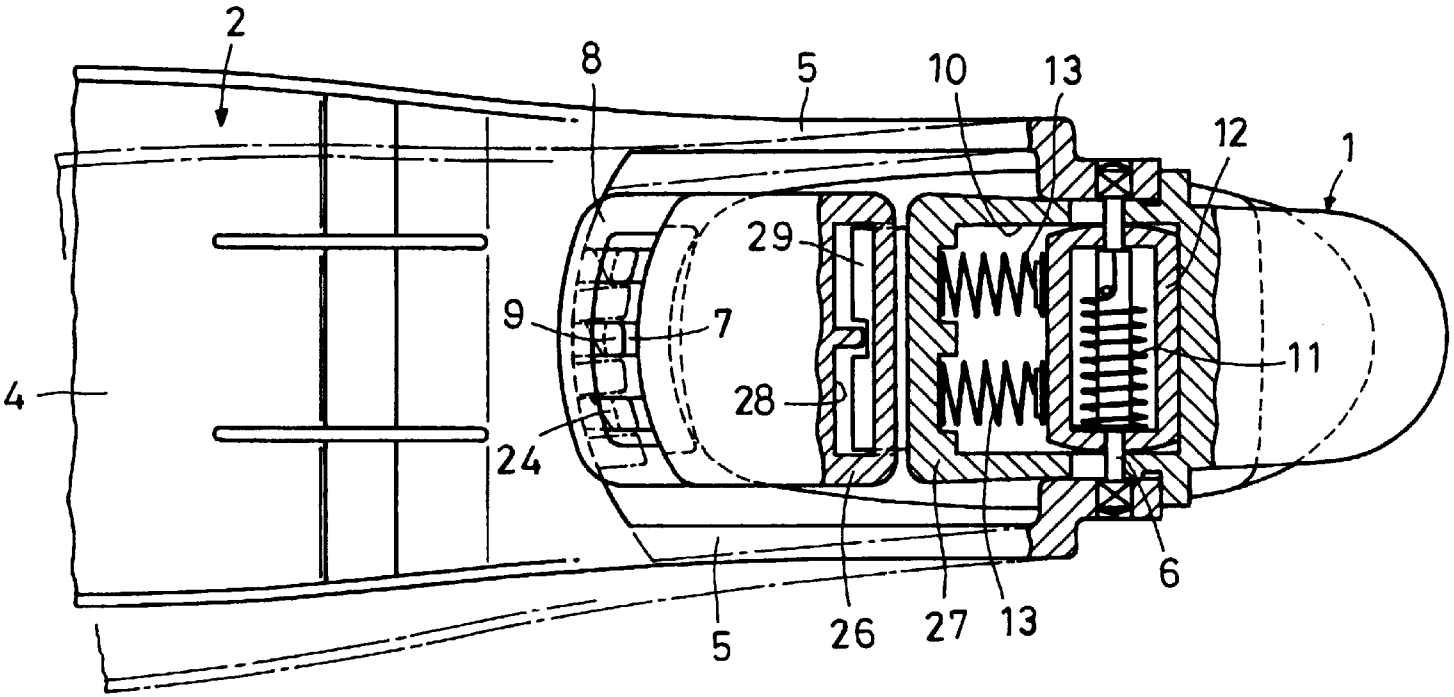
FIG. 11 is a partial sectional plan view seen from below of the diving flipper of FIG. 8.

A spring chamber 10 is formed inside of the body 1 as shown in FIG. 11, and inside the spring chamber 10 a twisted coil spring 11 placed around the axis 6 is contained in a spring case 12 in order to provide force to fold the blade 2.

Both sides of the spring case 12 are of an arc form, and the sides are controlled by the side of the spring chamber 10 so that the body 1 and the blade 2 slide from side to side in relation to each other.

Two compressed coil springs 13 are placed between a front surface of the spring chamber 10 and a front surface of the spring case 12 so that the blade 2 is directed to a stable position relative to the body 1 by means of these compressed coil springs 13.

At the time of starting a dive from a sand beach utilizing the above described diving flipper, a foot is inserted into the foot pocket 19 and the foot is secured to the body 1 with the strap 20. Here, at the time of utilization of such a strap type flipper, a boot is usually worn on the foot.

Then, as shown in FIG. 9, in the folded position where the blade 2 is stood up, the user walks to a place of a certain water depth. At this time, as shown with a broken line in FIG. 10, since the foot securing base 22 of the body 1 flexes together with the foot, the user can walk without a great deal of unnatural feeling. Next, when the webbed part 4 of the blade 2 is stepped on with the opposite foot, the sloped surface 24 of the protruding parts 7 and 9 slide away from each other so that the blade 2 is placed down while shifting to the side as shown with a broken line in FIG. 11, and is secured to the body 1 through engagement between the protruding parts 7 and 9.

Here, since the engagement mechanism between the protruding parts 7 and 9 is located at a distance above a bottom surface of the body 1, no sand disturbs the engagement mechanism between the protruding parts 7 and 9 even if a bottom part of the body 1 is buried in the sand. Even in the case that sand covers this part, the sand drops through the aperture 25 of the support 8 which is provided as a means for preventing sand from accumulating so that the protruding parts 7 and 9 can engage without fail.

In addition, as for the above diving flipper, the blade 2 can be secured with a slight amount of force by being shifted to the side without being pulled to the front in resistance to pressure of the compressed coil springs 13, and therefore, even in the case that the blade 2 unexpectedly becomes raised in the water, it can easily be put back to the position for use by being stepped on with the opposite foot.

In this manner, accordance with a diving flipper according to the present invention, the blade 2 can be easily secured to the body 1 even in the water by simply shifting the blade to the side.

Figure 12:
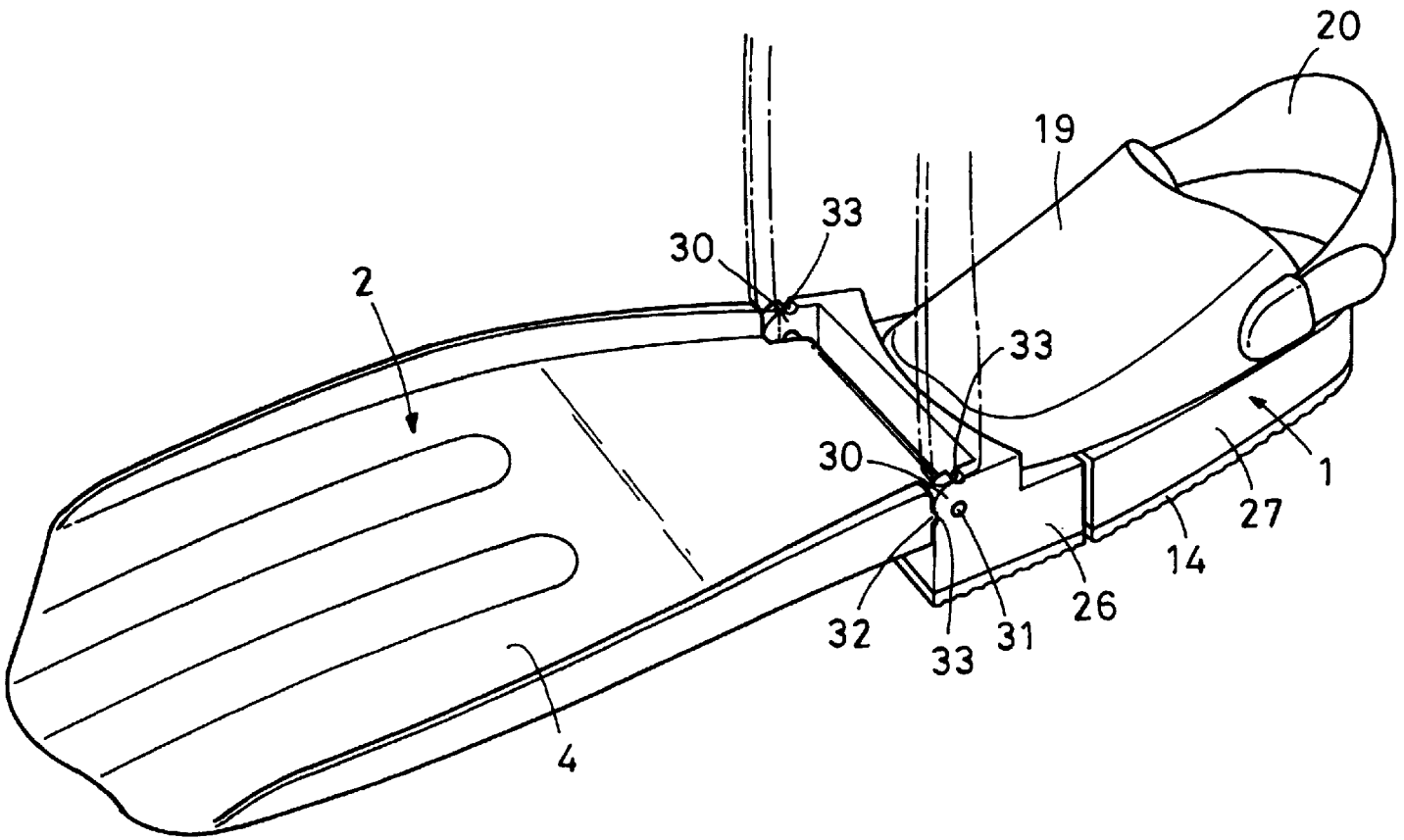
FIG. 12 is a perspective view showing yet another diving flipper according to the present invention.

Next, still another diving flipper is described focusing on the primary characteristics with reference to FIG. 12.

This flipper comprises a body 1 and a blade 2, wherein the blade 2 is attached to both side walls 30 of a front end of the body 1 so as to be freely rotatable via an axis 31. Upper corner parts of the side walls 30 are formed of an arc form so that both side parts of a rear end of the blade 2 move around the arc and are pressed at a front end and at an upper end of the side walls 30 in position for use and in the folded position.

Projections 32 are provided at both sides of the rear end of the blade 2, and notches 33 are provided at the front end and at the upper end of each of the side walls 30 so that the blade 2 is fixed at the position for use and at the folded position through engagement between the projections 32 and the notches 33.

In such a configuration, it becomes unnecessary to extend stays from the blade 2, and design and fabrication become easy while strength and durability increase.

In this manner, in accordance with a diving flipper according to the present invention, it becomes unnecessary to extend stays from the blade so that a simple and inexpensive product can be provided.

Here, though the above diving flipper is shown where a foot pocket 19 is provided on the body 1, a boot may be provided as shown in FIG. 3 in place of the foot pocket 19. In addition, the blade 2 may be of a variety of forms as long as a propulsion force created by using the flipper in water is taken into consideration.

In addition, though in the diving flipper shown in FIGS. 8 to 11, three protruding parts 7 and three protruding parts 9 are shown, the number of protruding parts 7 and 9 may be one each or may be of other numbers as long as engagement and release are possible.

In addition, elasticity of rubber, resin, or the like, may be utilized in place of twisted coil spring 11 or compressed coil springs 13.

In addition, a stopper may be provided on the body 1 for limiting a folded position angle of the blade 2 in order to prevent the blade 2 from contacting the lower leg of the user in the folded position.

As described above in accordance with the diving flipper according to the present invention, even in the case that a bottom part of the body is buried in sand, the blade can be secured to the body without fail.

In addition, in accordance with a diving flipper according to the present invention, the foot securing base of the body flexes along the sole of the foot at the time of walking so that the user can walk naturally.

Figure 13:
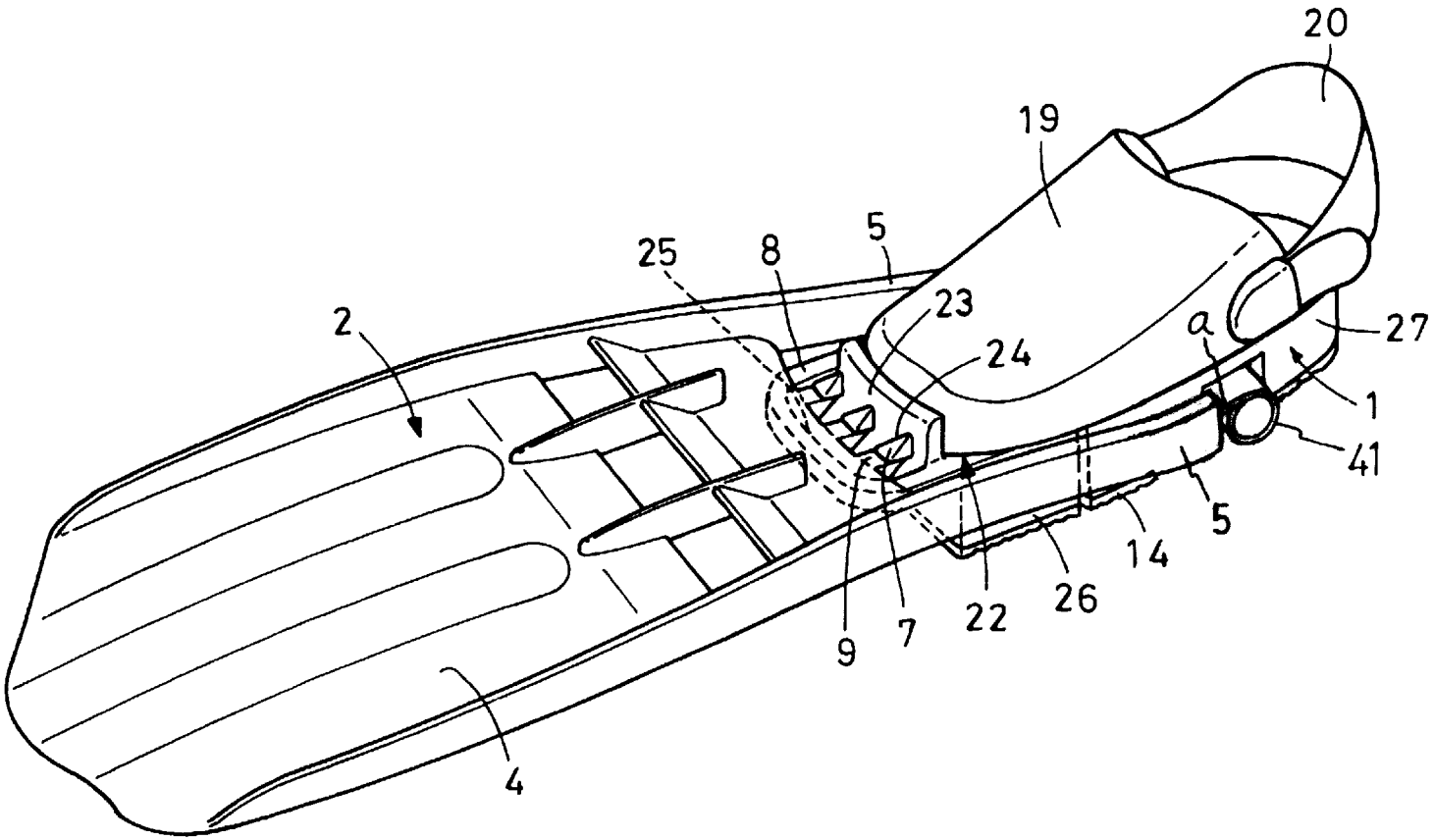
FIG. 13 is a perspective view showing still another diving flipper in a position for use according to the present invention.
Figure 14:
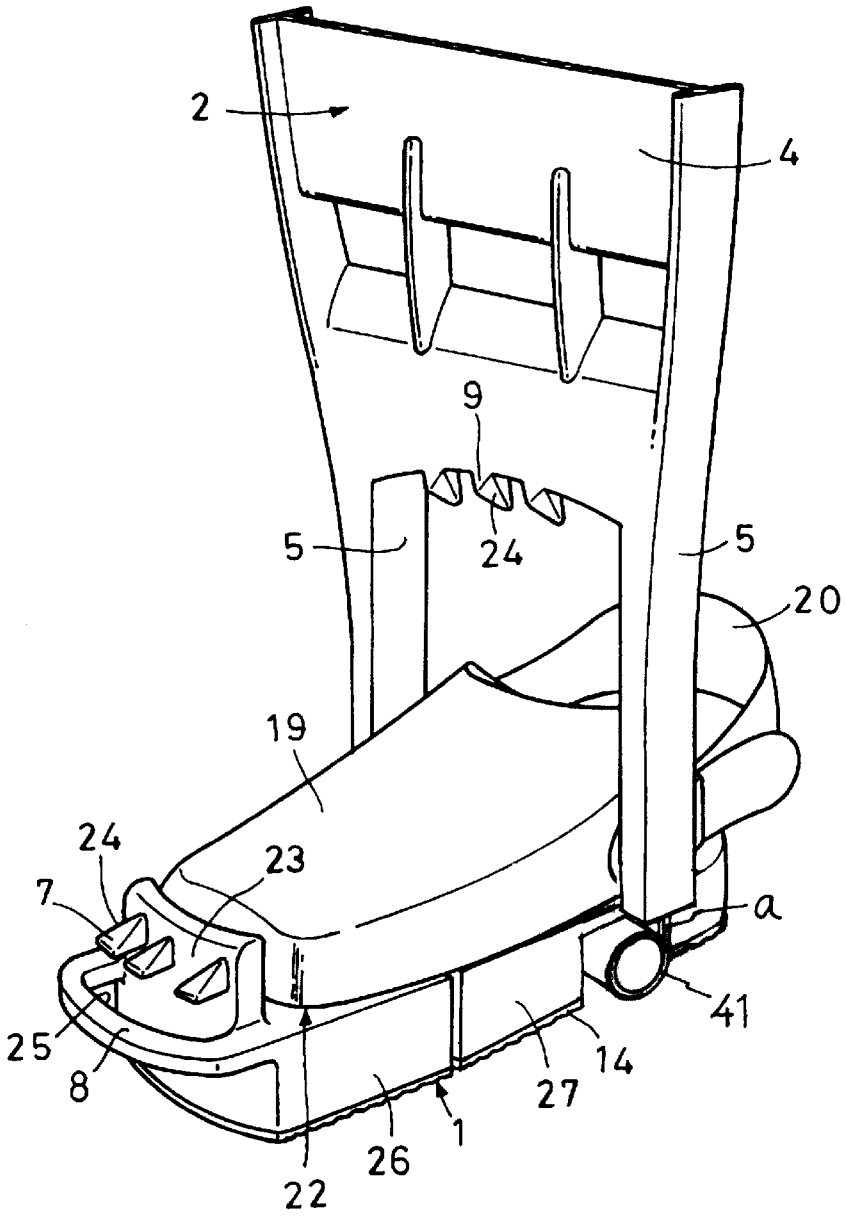
FIG. 14 is a perspective view showing the diving flipper of FIG. 13 in a folded position according to the present invention.
Figure 15:
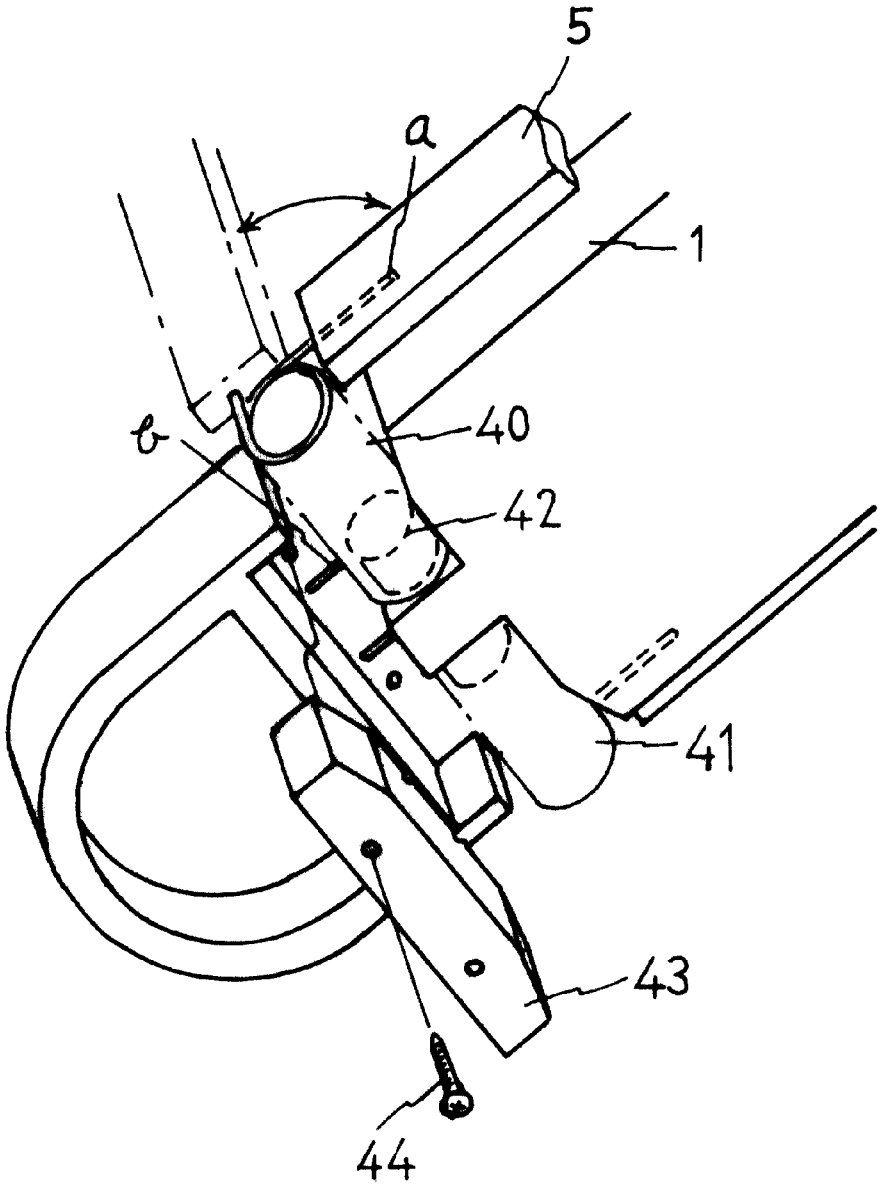
FIG. 15 is an enlarged perspective view of a base of the diving flipper of FIGS. 13 and 14 according to the present invention.

FIGS. 13–15 show yet another diving flipper according to the present invention, and this diving flipper has a body 1 which is secured to a foot and a blade 2 which can be switched between two positions, i.e. a position for use and a folded position.

Ends of stays 5 which extend rearwardly from both sides of a webbed part 4 of the blade 2 are attached to the body 1 through springs 40 and 41 as shown in FIG. 15.

That is to say, the blade 2, which is not directly supported by a rod, is attached to the body 1 through coil springs 40, 41 which allow switching of the blade by means of elasticity.

In the diving flipper shown in FIG. 15 springs 40 and 41 are provided on the right and left of the body 1, respectively. In the following, the spring 40 is descried and the spring 41 has the same structure.

One end (a) of the spring 40 is attached to one stay 5 while another end (b) is attached to the body 1.

As for a method of attachment to the body 1, the end (b) is prevented from rotation by means of a lid 43 which is secured by a screw 44 and is supported by a protrusion 42 so as to extend in a lateral direction of the diving flipper as shown in FIG. 15.

Next, the end (a) of the spring 40 is attached to the one stay 5 and the spring 40 works to provide a continuous force in the direction toward the folded position (the condition shown in FIG. 14 or the condition of the broken line of the stay 5 as shown in FIG. 15) of the diving flipper.

In addition, the end (a) of the spring 40 is allowed to rotate by twisting the entirety of the spring 40 relative to the end (b), and thereby, the spring allows the blade 2 to be switched between the position for use as shown in FIG. 13 and the folded position as shown in FIG. 14 by means of the elasticity of the spring.

When utilizing the diving flipper described above, the webbed part 4 of the blade 2 is stepped on with the opposite foot at a certain depth of water before starting diving from a sand beach (referred to as beach entry).

Thereby, the protruding parts 7 and 9 mutually slide on the inclined surface 24 so that the blade 2 moves towards a pressed down direction while sliding to the side, and the protruding parts 7 and 9 become mutually engaged. Here, the movement of the blade 2 so as to be shifted to a side at the time when the protruding parts 7 and 9 mutually slide becomes possible because the end (a) of the spring 40 (see FIG. 15) moves in the forward and backward direction due to its elasticity, so that the stay 5 can shift forward or backward.

As a result, blade 2 is switched to the position for use as shown in FIG. 13 so as to be used as an ordinary flipper in a sea or in other water.

Next, when a diver has on this diving flipper and boards a boat after diving is completed, the diver holds a ladder hung from the boat and twists his foot to press the side of the diving flipper against the ladder. Then, the protruding parts 7 and 9 mutually disengage so that the blade 2 rises up to the folded position as shown in FIG. 14 due to a continuous force working toward the direction of the folded position by means of the spring 40.

In addition, in the case that the diver returns to shore instead of to a boat after completing diving, the diver may twist his foot to press the side of the diving flipper against a seabed or against a rock. Thereby, in the same manner, the blade rises up to the folded position as shown in FIG. 14 so that the diver can walk to the shore without taking off the diving flipper.

Though in the above diving flipper the springs are a pair of coil springs, a piece of elastic body such as a piece of rubber may be used for the attachment between the blade 2 and the body 1 at the front of the body.

And, though in the above diving flipper the springs work to provide continuous force toward the folded position, by attaching one coil spring instead of a pair of coil springs to the body 1 so as to be rotatable, and by attaching the stays 5 on both ends thereof, a diving flipper is provided where no force works in either the direction toward the folded position or the direction toward the position for use so that the user can manually move the blade.

Since elastic bodies are used for switching the positions of the blade, the mechanism thereof is very simple in that there is no connection to a rod, and the user can maintain the diving flipper by only washing with water after use.

While the invention has been shown and described in detail, the foregoing description is in all aspects illustrative and not restrictive. It is therefore understood that numerous other modifications and variations can be devised without departing from the scope of the invention.

What is claimed is:

1. A diving flipper comprising:

a flipper body for receiving a foot; and a blade attached to said flipper body so as to be rotatable between at least a position for use and a folded position, said flipper body having an engagement part and said blade having a part for engaging said engagement part such that when said engagement part engages said part for engaging said engagement part, said blade is secured in the position for use, wherein either said engagement part or said part for engaging said engagement part exhibits a sloped surface on each side of said engagement part and said part for engaging said engagement part, at a point of contact between said engagement part and said part for engaging said engagement part, such that prior to said engagement part engaging said part for engaging said engagement part said blade slides laterally while being pressed downwardly.

2. The diving flipper according to claim 1, wherein said blade is attached to said flipper body via a rod such that said blade is rotatable about an axis of said rod.

3. The diving flipper according to claim 2, further comprising a mechanism for providing a force to rotate said blade in one direction.

4. The diving flipper according to claim 3, wherein said mechanism is for providing a force to rotate said blade in the one direction toward the folded position.

5. The diving flipper according to claim 4, wherein said mechanism includes:

a frame in a lower part of said flipper body for supporting said rod; and a device, in said frame, for rotating said rod in the one direction.

6. The diving flipper according to claim 5, wherein said device for rotating said rod comprises a coil spring surrounding said rod, with one end of said coil spring attached to said rod and another end of said coil spring attached to said frame.

7. The diving flipper according to claim 2, further comprising a mechanism for allowing said blade to slide relative to a direction of rotation of said blade about the axis of said rod.

8. The diving flipper according to claim 7, wherein said mechanism includes a frame in a lower part of said flipper body, with said frame slidably supporting said rod.

9. The diving flipper according to claim 8, wherein said mechanism further includes structure for holding said rod in a position.

10. The diving flipper according to claim 9, wherein said structure comprises plural coil springs between said rod and an inner surface of said frame.

11. The diving flipper according to claim 8, further comprising:

another frame positioned within said frame; and a device, in said another frame, for rotating said rod in one direction.

12. The diving flipper according to claim 4, wherein said another frame includes a cylindrical outer surface which is to contact an inner surface of said frame.

13. The diving flipper according to claim 1, wherein said blade is attached to said flipper body via an elastic body.

14. The diving flipper according to claim 13, further comprising a mechanism for providing a force to rotate said blade in one direction.

15. The diving flipper according to claim 14, wherein said mechanism is for providing a force to rotate said blade in the one direction toward the folded position.

16. The diving flipper according to claim 14, wherein said mechanism comprises said elastic body.

17. The diving flipper according to claim 13, further comprising a mechanism for allowing said blade to slide relative to a direction of rotation of said blade.

18. The diving flipper according to claim 17, wherein said mechanism includes structure for holding said blade in a position.

19. The diving flipper according to claim 17, wherein said mechanism comprises said elastic body.

20. The diving flipper according to claim 13, wherein said elastic body comprises plural coil springs, with respective first ends of said plural coil springs attached to said blade and respective second ends of said plural coil springs attached to said flipper body.

21. The diving flipper according to claim 20, wherein said flipper body includes a protrusion, and said plural coil springs are supported by said protrusion.

22. A diving flipper comprising:

a flipper body for receiving a foot;

a blade attached to said flipper body via a rod so as to be rotatable about an axis of said rod between at least a position for use and a folded position; and a mechanism for allowing said blade to slide relative to a direction of rotation of said blade about the axis of said rod.

23. The diving flipper according to claim 22, wherein said mechanism includes a frame in a lower part of said flipper body, with said frame slidably supporting said rod.

24. The diving flipper according to claim 23, wherein said mechanism further includes structure for holding said rod in a position.

25. The diving flipper according to claim 24, wherein said structure comprises plural coil springs between said rod and an inner surface of said frame.

26. The diving flipper according to claim 23, further comprising:

another frame positioned within said frame; and a device, in said another frame, for rotating said rod in one direction.

27. The diving flipper according to claim 26, wherein said another frame includes a cylindrical outer surface which is to contact an inner surface of said frame.

28. A diving flipper comprising:

a flipper body for receiving a foot;

a blade attached to said flipper body via an elastic body so as to be rotatable between at least a position for use and a folded position; and a mechanism for allowing said blade to slide relative to a direction of rotation of said blade.

29. The diving flipper according to claim 28, further comprising another mechanism for providing a force to rotate said blade in one direction.

30. The diving flipper according to claim 29, wherein said another mechanism is for providing a force to rotate said blade in the one direction toward the folded position.

31. The diving flipper according to claim 29, wherein said another mechanism comprises said elastic body.

32. The diving flipper according to claim 28, wherein said mechanism includes structure for holding said blade in a position.

33. The diving flipper according to claim 28, wherein said mechanism comprises said elastic body.

34. The diving flipper according to claim 28, wherein said elastic body comprises plural coil springs, with respective first ends of said plural coil springs attached to said blade and respective second ends of said plural coil springs attached to said flipper body.

35. A mechanism for rotating a blade relative to a flipper body, comprising:

a rod to which the blade is attached;

a first frame for supporting said rod such that the blade is rotatable about said rod; and a second frame for supporting said first frame such that said first frame is slidable within said second frame, with said second frame being provided in the flipper body, wherein the blade is attached to the flipper body via the mechanism so as to be rotatable between at least a position for use and a folded position, wherein the flipper body has an engagement part and the blade has a part for engaging the engagement part such that when the engagement part engages the part for engaging the engagement part, the blade is secured in the position for use, and wherein either the engagement part or the part for engaging the engagement part exhibits a sloped surface on each side of the engagement part and the part for engaging the engagement part, at a point of contact between the engagement part and the part for engaging the engagement part, such that prior to the engagement part engaging the part for engaging the engagement part the blade slides laterally while being pressed downwardly.

36. The mechanism according to claim 35, further comprising a device for providing a force to rotate the blade in one direction about an axis of said rod.

37. The mechanism according to claim 36, wherein said device includes a coil spring surrounding said rod, with one end of said coil spring attached to the blade and another end of said coil spring attached to either said first frame or said second frame.

38. The mechanism according to claim 36, wherein said device includes a coil spring surrounding said rod, with one end of said coil spring attached to the blade and another end of said coil spring attached to any of said rod, said first frame or said second frame.

39. The mechanism according to claim 35, further comprising structure for holding said first frame in a position.

40. The mechanism according to claim 39, wherein said structure comprises plural coil springs between an outer surface of said first frame and an inner surface of said second frame.

41. The mechanism according to claim 39, wherein said second frame exhibits elasticity, and said structure comprises said second frame.

42. The mechanism according to claim 35, wherein said first frame includes a cylindrical outer surface which is to contact an inner surface of said second frame.

* * * * *